United States Patent [19]

Cerny et al.

[11] 4,315,188

[45] Feb. 9, 1982

[54] WIRE ELECTRODE ASSEMBLAGE HAVING ARC SUPPRESSION MEANS AND EXTENDED FATIGUE LIFE

[75] Inventors: Daryl D. Cerny, Greenville, Ohio; Kurt Lining, Muncie, Ind.

[73] Assignee: Ball Corporation, Muncie, Ind.

[21] Appl. No.: 122,549

[22] Filed: Feb. 19, 1980

[51] Int. Cl.[3] ..... H01J 1/18; H01J 19/12

[52] U.S. Cl. ..... 313/269; 55/146; 55/153; 313/333; 339/271; 339/269

[58] Field of Search ..... 313/333, 269, 271; 55/146-148, 153, 151; 339/271, 276, 279, 269, 263

[56] References Cited

U.S. PATENT DOCUMENTS

| | | | |
|---|---|---|---|
| 2,648,054 | 8/1953 | Berg | 339/276 |
| 2,866,517 | 12/1958 | Phyl | 55/147 X |
| 3,452,325 | 6/1969 | Paulve | 339/271 X |
| 4,099,219 | 7/1978 | Laing | 55/147 |
| 4,134,040 | 1/1979 | Klotzman | 313/333 |
| 4,136,924 | 1/1979 | Dobrosielski et al. | 339/263 R |
| 4,175,816 | 11/1979 | Burr | 339/276 R |

FOREIGN PATENT DOCUMENTS

| | | | |
|---|---|---|---|
| 45-20477 | 11/1970 | Japan | 55/147 |

*Primary Examiner*—Saxfield Chatmon, Jr.
*Attorney, Agent, or Firm*—Nicholas T. Bokides

[57] ABSTRACT

One end of an electrode wire is doubled back at least once forming a teardrop shaped loop around a connector with the terminal end of the wire placed adjacent the wire inwardly of the connector. A rounded conductive mass encapsules said terminal end and the wire. This mass suppresses the field generated at the terminal end of the wire, provides mass dampening inwardly of the connector and distributes the load over both sides of said teardrop shaped loop. A converging restraining means may be disposed over and in contact with both sides of said loop intermediate said mass and said connector thereby providing additional dampening and an ultimate limit on loop movement. The connector has a circular groove within which the base portion of the loop is tightly accommodated by crimping the connector thereover. Preferably, the connector should be constructed from a metal having a substantially lower modulus of elasticity than the wire to preserve the cross-sectional stress area of the wire in so crimping.

20 Claims, 6 Drawing Figures

WIRE ELECTRODE ASSEMBLAGE HAVING ARC SUPPRESSION MEANS AND EXTENDED FATIGUE LIFE

BACKGROUND OF THE INVENTION

This invention relates to a wire electrode assemblage suitable for use in a variety of electrostatic apparatus and more particularly, to a wire electrode assemblage which will resist breakage under vibration and which is provided with arc-suppression means.

Electrostatic apparatus and methods are used in many industrial applications for applying a coating material to a substrate. One of the recent industrial applications of electrostatics is in placing a uniform lubricant coverage on a metal substrate at high speeds as disclosed in U.S. Pat. No. 4,066,803 to Scholes et al.

When such apparatus are placed on a continuous metal production line, or in other industrial production line settings, it is imperative that operation of the apparatus be reliable. Any breakdown, even for a few minutes, can cause stoppage of the line and require substantial time and expense in a subsequent start up.

One problem which has plagued some of these apparatus is breakage of the thin wire electrodes. This problem is especially significant where the wire electrodes vibrate, such as when an alternating current is imposed upon them.

A vibrating wire secured between two fixed points will undergo cyclic bending loads at each of the fixed points. If the load is of a sufficient magnitude to result in plastic deformation, a failure will occur after relatively few cycles. Assuming no plastic deformation, the wire electrode will still have a finite life depending on the fatigue life of the wire at a given magnitude of load cycle. Because the fatigue life in cycles increases as a logarithmic function of a decrease in the magnitude of the cyclic load, it will be appreciated that even a minor decrease in load will result in a substantial increase in fatigue life.

Another substantially contributing factor to fatigue at the point a wire is secured may be the method of securing the wire. If the method of securing results in crimping or plastically deforming the wire, a reduction in the cross-sectional area may occur which, given the same absolute magnitude of forces being applied to the wire, will result in a greater load per unit area at the fixed point and a logarithmically related shortened fatigue life.

Another problem which is sometimes encountered with wire electrodes is arcing from the sharp terminal end of the wire to ground. This is due to the much higher electric field generated at the terminal end of the wire than is generated along the length of the wire. Where such arcing occurs the electric potential which can readily be applied to the electrode may be limited to a level below that which is necessary for proper functioning of the electrostatic apparatus.

SUMMARY OF THE PRESENT INVENTION

In accordance with the present invention, a wire electrode assemblage having an increased fatigue life and arc-suppression means is provided. Increased life is achieved by dampening or limiting the amplitude of vibration reaching the fixed point of attachment and by securing the electrode to said fixed point without substantially altering the cross-sectional shape of the wire. Arc-suppression is achieved by surrounding the terminal end of the wire with a rounded conductive mass thereby decreasing the intensity of the electric field therein generated.

In one embodiment of the present invention, the terminal end of a wire is doubled back and placed adjacent said wire thereby forming a loop like extremity. Disposed within said loop adjacent the base portion thereof is a connector having wire clamping means, said clamping means securing said wire against slippage without substantially altering the cross-sectional form of said wire. A rounded conductive mass encapsules and secures the terminal end of said wire inwardly of said connector, said securing aiding in the prevention of slippage of said wire around said connector and said encapsuling reducing the field generated by the terminal end. The rounded mass also contributes a mass dampening effect inwardly of the point of attachment of said wire. A restraining means may be disposed intermediate said connector and said mass to reduce the vibration reaching the point at which said wire is connected to said clamping means resulting in lowered cyclic bending loads on said wire and a substantially greater fatigue lifetime.

In a preferred embodiment of the present invention, said clamping means is a channel or groove space around said connector which tightly accommodates said loop. Higher slip resistance is achieved by wrapping said wire at least twice around said connector in said channel or groove space.

Although a number of structures perform adequately as restraining means, the preferred embodiment utilizes a tubular member having a circular inner peripheral surface, said surface in contact with both sides of said loop. In operation, the tubular member progressively forces the sides of the loop inwardly as the loop is displaced, in a direction perpendicular to the plane containing the loop, from center position.

Accordingly, it is an object of this invention to provide an electrode assemblage having a greatly increased life.

It is another object of this invention to reduce the stress which the fixed points of a vibrating wire undergo at the fixed points of attachment.

It is a further object of this invention to eliminate the high field generated at the terminal end of a wire used in electrode assemblages.

It is a further object of this invention to reduce the amplitude of vibration reaching the fixed points of attachment.

It is another object of this invention to provide a simple way of securing a wire electrode which is to be placed under tension without crimping, plastically deforming or substantially altering the cross-sectional shape of said wire where so secured.

It is a further object of the present invention to provide an electrode assemblage with a long fatigue lifetime which is easily placed under tension.

These and other objects, features and advantages of the present invention will become more fully apparent from the following detailed description of a preferred embodiment, the appended claims and accompanying drawings.

DETAILED DESCRIPTION OF A PREFERRED EMBODIMENT

Figure 1:
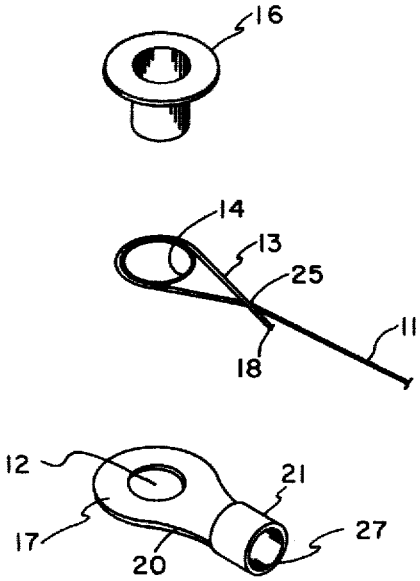
FIG. 1 is an exploded view of a connector and the wire.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

Figure 2:
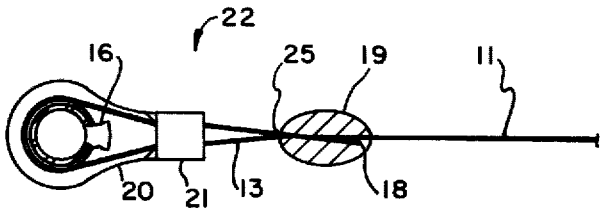
FIG. 2 is a fragmented top view of an electrode assemblage constructed in accordance with the present invention.

FIG. 2 illustrates a fragmented top view of an electrode assemblage generally designated as 22. A connector, best shown in FIG. 1, is constructed of a flanged eyelet 16 and base plate 17, the base plate having a hole 12 to receive the tubular portion of eyelet 16.

An end of wire 11 is doubled back at least once around eyelet 16 to form a teardrop shaped loop 13. Where the electrode is to be placed under tension, said end may be doubled back more than once thereby forming coil 14 around eyelet 16 and providing greater resistance to slippage of the wire around the eyelet. The terminal end 18 of wire 11 is placed adjacent the wire inwardly from the connector. A rounded conductive mass 19 encapsules and secures terminal end 18 and the apex 25 of the teardrop shaped loop 13.

Figure 4:
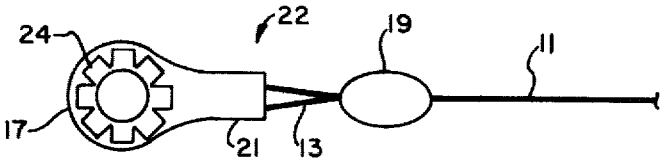
FIG. 4 is a bottom view of the electrode assemblage in FIG. 2.

A channel or groove space which tightly accommodates coil 14 and the base portion of teardrop shaped loop 13 is created by inserting the tubular portion of eyelet 16 through hole 12 in base plate 17 and tightly squeezing base plate 17 and the flanged portion of eyelet 16 together, then flanging the tubular member outwardly over the backside of base plate 17 thereby forming a number of flanges 24, as shown in FIG. 4. In forming the groove or channel space, care must be taken that the cross-sectional shape of the wire is not substantially altered. This may be accomplished by constructing the eyelet and/or the base plate from a material having substantially greater ductibility than the wire, i.e. material having a lower modulus of elasticity than the wire. In the preferred embodiment, an eyelet of brass is used in conjunction with wire of a stainless steel 302 alloy.

Figure 5:
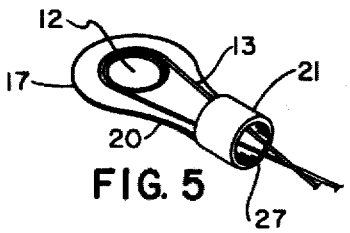
FIG. 5 is an angled view illustrating the relation between the loop and tubular member.

A loop movement restraining means may be disposed over loop 13 intermediate said mass and said connector. In the preferred embodiment, said restraining means is a tubular member 21, said tubular member having a circular inner peripheral surface 27 in contact with both sides of loop 13 as best shown in FIG. 5. An extension 20 from base plate 17 supports tubular member 21 and fixes said member relative to the connector. Although excellent results have been obtained with tubular member 21, many other converging structures which contact both sides of loop 13 and are fixed relative to the connector may perform adequately as loop restraining means.

Figure 6:
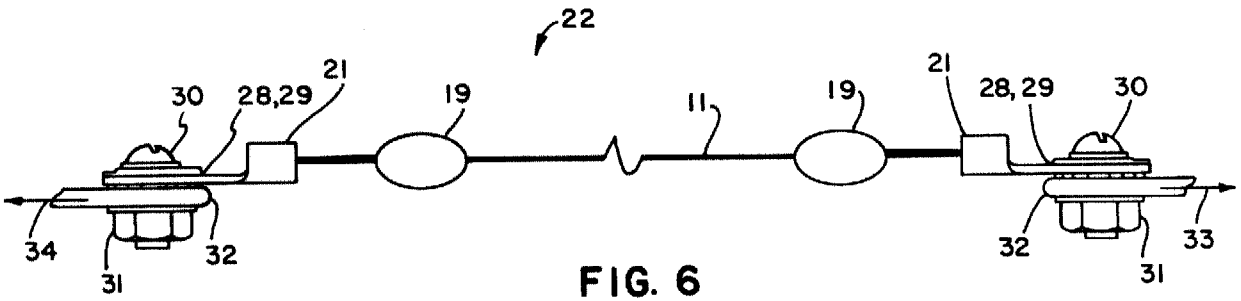
FIG. 6 is an electrode assemblage in place between two outwardly biased terminals.

FIG. 6 illustrates the attachment of an electrode assemblage between two tension biased terminals referenced as 32. The connectors are secured to terminals 32 by bolts 30 and nuts 31. Arrows 33 and 34 indicate the direction of biasing, which may be accomplished by conventional means, such as coil or cantilever springs.

Figure 3:
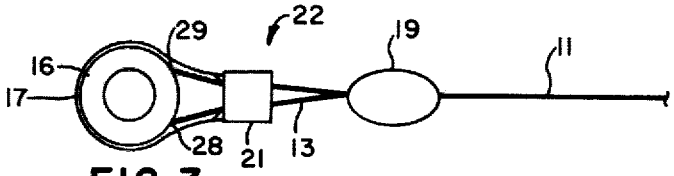
FIG. 3 is an unfragmented view of FIG. 2.

In operation, vibration may be set up in wire 11 by the imposition of an alternating current thereon or through the frictional forces which are generated by movement of the gaseous atmosphere surrounding the wire. As noted above, a vibrating wire will eventually suffer fatigue failure at the points at which the wire is fixed which are referenced by numerals 28 and 29 as best shown in FIG. 3. The fatigue life of the present invention is substantially extended by reducing the cyclic bending loads on the wire at these points. This is accomplished by carefully preserving the cross-sectional stress are of the wire where the wire is secured to the connector and reducing the amplitude of vibration reaching points 28 and 29.

The amplitude of vibration reaching points 28 and 29 is reduced by the dampening effect of conductive mass 19. Further dampening may be provided by loop restraining means 21. As both sides of wire loop 13 are in contact with the loop restraining means, any movement of said loop will be dampened by the frictional forces generated at the points of contact. The converging structure of the loop restraining means results in a progressively increasing component of force, as said loop is displaced from center position, on said loop at the points of contact tending to force said loop to the center position of the loop restraining means. Also, the diameter of said loop restraining means acts as an ultimate limit on the amplitude of movement possible to said loop.

In addition to dampening vibration and reducing the electric field generated at the terminal end of the wire, rounded conductive mass 19 serves as a load distributor by securing looped terminal end 18 to the wire. This distributes the tensile and bending loads, albeit not equally, over both points 28 and 29 resulting in a substantial extension of said points life in comparison to a conventional single strand arrangement where the full load is borne at a single point.

The exact shaping and size of mass 19 are not critical except that to avoid generation of a high electric field and to provide sufficient dampening, the mass should have no sharp corners and be approximately commensurate in cross-sectional area with said connector as illustrated in the drawings.

The mass may be constructed from a number of metals or metal alloys. For simplest construction of the electrode assemblage, use of a high weight ductile metal is recommended. In the preferred embodiment, mass 19 is a number 4 split lead shot which is crimped over terminal end 18 and apex 25 of loop 13.

Generally, in electrostatic apparatus, the wire electrodes will be of the smallest diameter functionally capable of carrying the required current and mechanical loads thereby promoting the highest electric field possible for a given magnitude of electric potential. In the present invention, the diameter of the channel or groove space around said connector should be large enough in relation to the wire so that minimal plastic deformation of the wire will occur in forming teardrop shaped loop 13. In the preferred embodiment, a wire having about a 0.009 inch diameter is used in conjunction with a channel space having about a 0.25 inch diameter.

It is believed that a careful consideration of the specification in conjunction with the drawings will enable one skilled in the art to obtain a clear and comprehensive understanding of the subject matter of the invention, the features and advantages, mode of use and improved result which is assured the user.

The foregoing is considered as illustrative only of the principles of the invention. Further, since a number of modifications and changes will readily occur to those skilled in the art, it is not desired to limit the invention to the exact construction shown and described; and, accordingly, all suitable modifications and equivalents may be resorted to falling within the purview of the invention as claimed.

What is claimed is:

1. An electrode assemblage comprising;
   a. a wire having an end doubled back to form a loop like extremity,
   b. a connector disposed within said loop,
   c. clamping means carried by said connector for securing the loop to said connector, and
   d. a rounded conductive mass encapsuling the wire and the terminal end of the doubled back loop.

2. An electrode assemblage as described in claim 1 including a restraining means disposed intermediate said mass and said connector for restricting lateral movement of the wire.

3. An electrode assemblage as described in claim 2 wherein said restraining means progressively forces the sides of said loop inwardly as said loop is displaced, in a direction perpendicular to the plane containing said loop, from center position.

4. An electrode assemblage described in claim 2 wherein said restraining means comprises a tubular member centered over said loop, said tubular member having a cylindrical inner peripheral surface in contact with both sides of said loop.

5. An electrode assemblage as described in claim 3 or 4 wherein said clamping means is a groove around about at least 180 degrees of said connector, said groove tightly accommodating said loop by crimping thereover, whereby said wire is restrained from slippage without substantially altering the cross-sectioned shape of said wire.

6. An electrode assemblage comprising;
   a. an electrode wire having one extremity doubled back to form a generally teardrop shaped loop,
   b. a conductive mass surrounding the wire portion forming the apex of said generally teardrop shaped loop, and
   c. a connector disposed within the confines of the teardrop shaped loop adjacent the base portion of the tear drop shaped loop and in electrical contact therewith.

7. An electrode assemblage as described in claim 6 including a loop movement restraining means between said mass and said connector for limiting lateral movement of the apex of said loop relative to the connector.

8. An electrode assemblage as described in claim 7 wherein said loop movement restraining means comprises a circular hollow member fixed in relation to said connector, said circular member having an inner peripheral surface in contact with both side of said teardrop shaped loop.

9. An electrode assemblage as described in claim 8 wherein said connector has a channel space around at least about 180 degrees of said connector, said channel space tightly containing the base portion of said generally teardrop shaped loop.

10. An electrode assemblage as described in claim 7 wherein said connector is of a generally circular shape having a channel space completely around the periphery thereof, said electrode wire having one extremity doubled back at least twice forming at least one coil and a teardrop shaped loop, and said channel space tightly confining said coil and the base portion of said teardrop shaped loop form slippage without substantially altering the cross-sectional shape of the wire forming said coil and said teardrop shaped loop.

11. An electrode assemblage as described in claim 10 wherein said connector has an extension therefrom, said loop movement restraining means comprises a tubular member centered over said loop, said tubular member having a circular inner peripheral surface in contact with both sides of said loop, and said tubular member is attached to and supported by said extension.

12. An electrode assemblage having vibration dampening and arc suppressing means, comprising;
   a. an electrode wire having a main portion and doubled back opposing end portions, each of said end portions having a terminal end of said electrode wire fixed immediately adjacent the main portion inwardly from the extremities of said electrode assemblage,
   b. a connector located within each of said doubled back end portions and in electrical contact therewith, and
   c. a conductive rounded mass surrounding said wire and encapsuling said terminal end for dampening vibration and reducing the electric field generated at the terminal end of a wire.

13. An electrode assemblage as described in claim 12 including an amplitude dampening means disposed between each of said masses and each connector for restricting movement of said wire while carrying high voltage.

14. An electrode assemblage as described in claim 13 wherein said amplitude dampening means is a structure that progressively forces the sides of said doubled back portions inwardly as said doubled back portion is displaced from center position.

15. An electrode assemblage as described in claim 13 wherein said amplitude dampening means is a tubular member centered over each of said doubled back portions, said tubular member having an inner circular peripheral surface in contact with both sides of said doubled back portion.

16. An electrode assemblage as described in claim 15 wherein said connectors have a substantially circular groove space around the periphery thereof, said doubled back portions have at least one coil of wire therewithin, and said coil of wire and part of said doubled back portion are tightly fitted within said groove space by crimping said connector thereover without substantially altering the cross-sectioned shape of said wire.

17. An electrode assemblage as described in claim 16 wherein said connector is constructed of a material having a substantially lower modulus of elasticity than said wire, whereby the cross-sectional shape of said wire will be preserved when crimping said connector thereover.

18. An electrode assemblage as described in claim 17 wherein said mass is about the size of a number 4 lead shot.

19. An electrode assemblage as described in claim 18 wherein said connector has means for attachment to a terminal, said means comprising a hole through said connector for mounting said connector on a post.

20. An electrode assemblage as described in claim 19 wherein said connector has an extension to which said tubular member is fixed.

* * * * *